US006149534A

United States Patent [19]

Peters et al.

[11] Patent Number: 6,149,534

[45] Date of Patent: Nov. 21, 2000

[54] BI-METALLIC GOLF CLUB HEAD WITH SINGLE PLANE INTERFACE

[75] Inventors: Michael R. Peters, Vista; Bret H. Wahl, Carlsbad, both of Calif.

[73] Assignee: Taylor Made Golf Company, Inc., Carlsbad, Calif.

[21] Appl. No.: 09/184,573

[22] Filed: Nov. 2, 1998

[51] Int. Cl.[7] ..... A63B 53/04

[52] U.S. Cl. ..... 473/345; 473/349

[58] Field of Search ..... 473/324, 338, 473/344, 349, 325–337, 350, 345, 346, 256

[56] References Cited

U.S. PATENT DOCUMENTS

| | | |
|---|---|---|
| D. 404,098 | 1/1999 | Ishikawa et al. . |
| 1,433,744 | 10/1922 | Rhind . |
| 1,621,750 | 3/1927 | Questel . |
| 2,332,342 | 10/1943 | Reach . |
| 3,941,390 | 3/1976 | Hussey . |
| 4,332,388 | 6/1982 | Crow . |
| 4,465,221 | 8/1984 | Schmidt . |
| 4,775,156 | 10/1988 | Thompson . |
| 4,834,387 | 5/1989 | Waites . |
| 4,872,685 | 10/1989 | Sun . |
| 5,294,037 | 3/1994 | Schmidt . |
| 5,501,459 | 3/1996 | Endo . |
| 5,527,034 | 6/1996 | Ashcraft et al. . |
| 5,582,553 | 12/1996 | Ashcraft et al. . |
| 5,658,207 | 8/1997 | Aizawa et al. . |
| 5,788,584 | 8/1998 | Parente et al. . |

FOREIGN PATENT DOCUMENTS

| | | |
|---|---|---|
| 10263122 | 6/1998 | Japan . |

OTHER PUBLICATIONS

U.S. Application No. 29/099181, Besnard et al., filed Jan. 15, 1999.

*Primary Examiner*—Sebastiano Passaniti
*Attorney, Agent, or Firm*—John L. Rogitz

[57] ABSTRACT

The present invention is a golf club head whose engagement surface is formed between an upper metal piece and a lower metal piece, the upper piece being composed of relatively lighter and less dense material and the lower piece being composed of relatively denser and heavier material. The union of the two pieces is along a single unitary plane. By utilizing this type of design, in which two engagement surfaces of different metallic composition are joined on a single plane to create a continuous engagement surface on the club head, the benefits of improved balance and enhanced performance that result from the lower piece being heavier than the upper piece can be achieved without the need to fit a precisely engineered weight into a precut opening in the golf club head, thus making the manufacture of golf club heads easier and more efficient.

13 Claims, 2 Drawing Sheets

BI-METALLIC GOLF CLUB HEAD WITH SINGLE PLANE INTERFACE

FIELD OF THE INVENTION

The present invention relates generally to golf clubs, and more particularly to golf club heads that are weighted for improved balance and enhanced performance.

BACKGROUND

Heavy soles have been provided on golf clubs to lower their center of gravity and thereby improve the balance of the clubs during the stroke. For clubs that were made of wood (hence the term "woods" to refer to modern metal-only drivers), a heavy metal insert was precisely fitted onto the bottom of the wood piece. More specifically, to enable the wood to bear the load of the metal weight during the stroke, a precise fit between the metal weight and the wood piece of the head was required in two planes, one more or less vertical and one more or less horizontal.

The precise, small-tolerance fit between a lower, heavier piece of the club head and a lighter upper piece was retained when all-metal club heads were developed. For example, U.S. Pat. No. 5,527,034 to Ashcraft et al. discloses a golf club head having an aluminum or brass body and a separate sole that fits into cavity which must be machined into the body, with machining being necessary to fit the sole and body together, Ashcraft et al. abstract and col. 3, lines 62–63. While machining can be time consuming, it is easier to machine aluminum or brass club heads such as the Ashcraft et al. head than it is to machine heads made of titanium, tungsten, copper, and iron. Accordingly, as recognized herein a precise fit in two interface planes between a lighter upper head piece and a heavier lower head piece, particularly when one piece includes titanium, tungsten, copper, or iron, complicates manufacturing and increases the time and expense required for making the club head. Fortunately, the present invention recognizes that it is possible to provide a two-piece golf club head without requiring a multi-plane interface.

SUMMARY OF THE INVENTION

The present invention includes a golf club head, an upper metal piece of which defines an upper engagement surface and a lower metal piece of which is heavier and more dense than the upper piece and which defines a lower engagement surface. The more dense lower piece results in an improved feel and lower center of gravity of a golf club on which the head is mounted, compared to an otherwise uniform head. Also, the present golf club head facilitates launching a golf ball into the air when struck, and the head passes more easily through turf during a swing as compared to a conventional head.

The upper engagement surface is positioned flush against the lower engagement surface in such a manner as to define one and only one single-plane interface between the upper and lower engagement surfaces of the club head. The upper and lower engagement surfaces do not interface with each other in any manner apart from this single-plane interface.

Thus, the present invention as herein described is manufactured by joining the upper and lower engagement surfaces along a single plane in such a way that the two engagement surfaces form one continuous engagement surface, then bolting the upper and lower engagement surfaces together, and then removing the excess metal from the lower or upper piece of the club head or otherwise blending the edges so that the union of the upper and lower engagement surfaces of the club face is smooth.

The present invention therefore obviates the need for insertion into precisely-cut openings in golf club faces of weights manufactured to exact tolerances, thereby rendering the process of manufacturing golf clubs more simple and more efficient.

It is of the essence of the present invention that the two head pieces define an interface in one single plane. For the purposes of this application, "an interface" is to be understood as "a condition in which two or more elements are situated in direct flush physical contact with one another," as is the case with the two pieces of the golf club in the present invention. A condition in which two or more elements are connected to each other by elements such as bolts or glue, is not considered as establishing a different interface in another plane, apart from the single plane.

The details of the present invention, both as to its structure and to its operation, can best be understood by reference to the accompanying drawings, in which like reference numerals refer to like parts, and in which:

DETAILED DESCRIPTION OF THE PREFERRED EMBODIMENT

It is to be understood that although each Figure in this description depicts a specific type of golf club, the following description applies equally to all types of clubs, including putters, irons, and woods.

Figure 1:
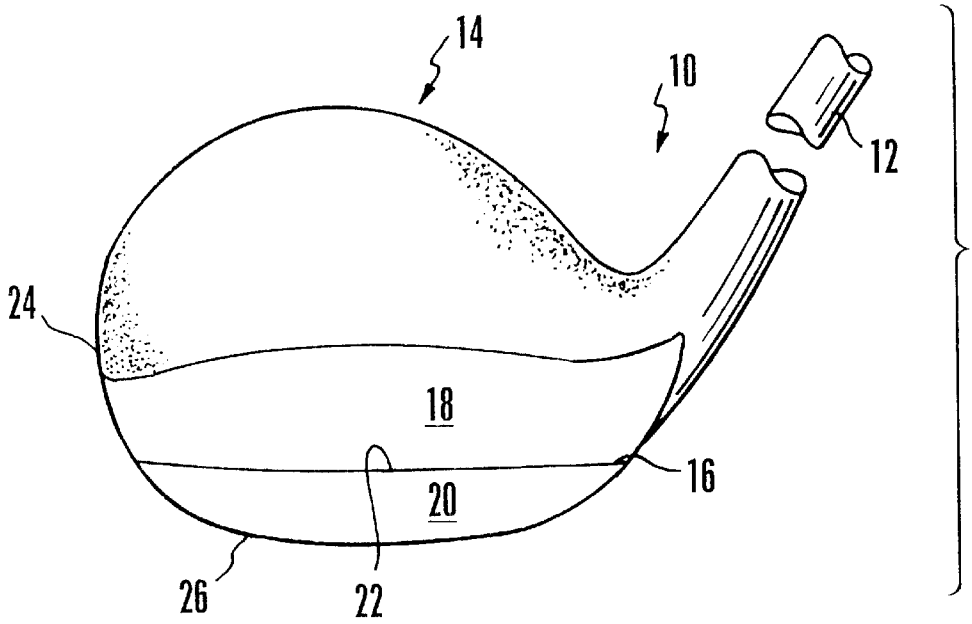
FIG. 1 is a perspective view of the present golf club head, with portions of the shaft broken away.
Figure 2:
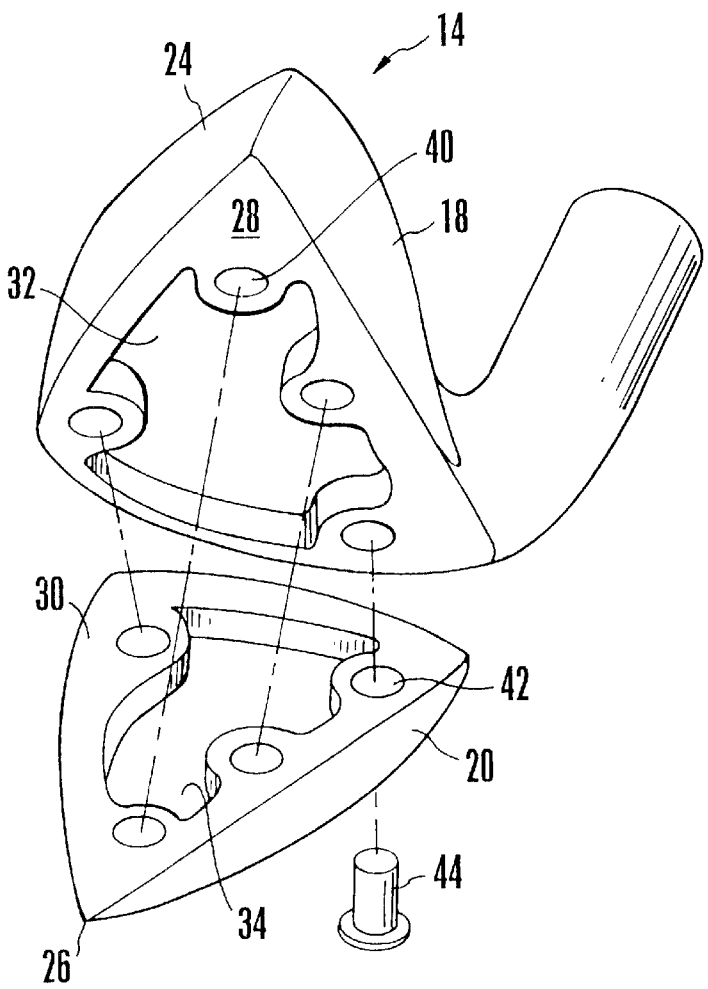
FIG. 2 is a perspective view of the golf club head, showing the heavier lower piece exploded away from the lighter upper piece and showing the pieces canted away from each other to show the interface surfaces of both pieces, showing only one of four bolts for clarity.

Now referring to FIGS. 1 and 2, a golf club is shown, generally designated 10, that includes a shaft 12 and a head, generally designated 14 that is attached to the shaft 12 by means known in the art. In FIG. 1, the unshaded portion represents a golf ball-striking surface 16 of the club 10, and the striking surface 16 includes an upper face 18 and a lower face 20, with the line 22 representing a single plane interface therebetween. If desired, the interface plane through line 22 can be canted upwardly or downwardly at one of a variety of angles. In one preferred embodiment, the interface plane is canted downwardly from the striking surface 16 at an angle of about five degrees (5°). It is to be understood that the interface plane need not extend through the striking surface 16.

As can be appreciated in reference to FIGS. 1 and 2, the upper face 18 is established by an upper, unitary, lighter, less dense piece 24 of the head 14 and a lower, unitary, heavier, more dense piece 26 of the head 14. In one preferred embodiment, the upper piece 24 of the golf club head 14 is made of relatively light and less dense materials, such as titanium or a titanium alloy or aluminum or aluminum alloy, while the lower piece 26 is made from relatively heavy and more dense materials, such as a copper-based alloy, a tungsten-based alloy, a nickel-based alloy, or an iron-based alloy.

As shown in FIG. 2, the upper piece 24 defines an upper engagement surface 28 and the lower piece 26 defines a lower engagement surface 30 configured for flushly abutting the upper engagement surface 28 in a single substantially planar junction. Thus, both engagement surfaces 28, 30 are substantially single-plane surfaces, with the understanding that some minor curvature in the surfaces 28, 30 renders the surfaces 28, 30 nonetheless "substantially planar". As shown, the upper and lower pieces 24, 26 can be hollow, and the surfaces 28, 30 need not be continuous, but instead can be continuous only along the peripheries of upper and lower cavities 32, 34 respectively defined by the upper and lower pieces 24, 26.

Figure 3:
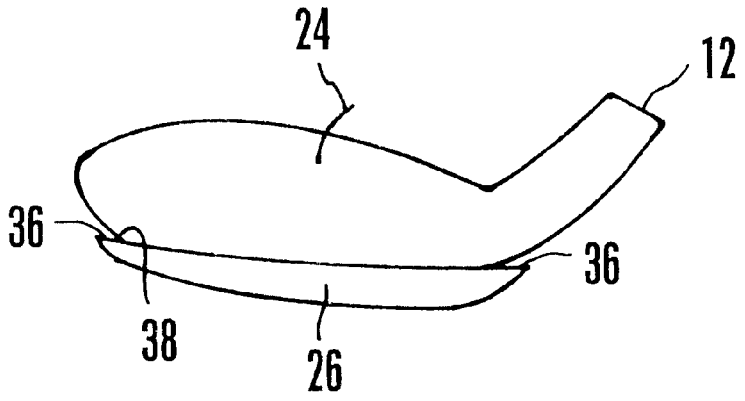
FIG. 3 is a side view of the club head prior to removing overlap areas of the lower piece.
Figure 4:
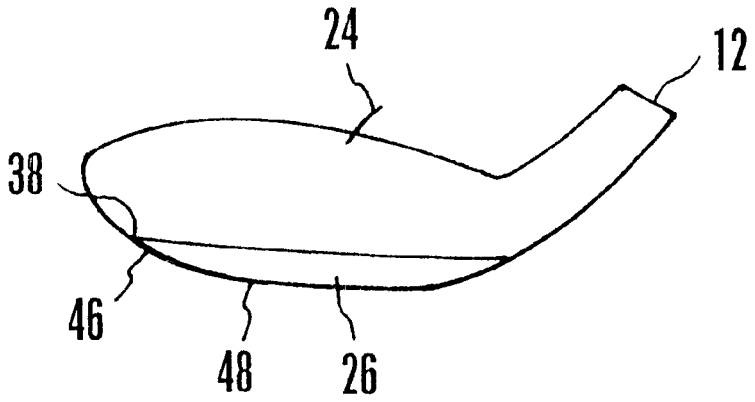
FIG. 4 is a side view of the club head shown in FIG. 3 after overlap areas of the lower piece have been removed to establish a flush perimeter interface between the two pieces of the club face.

FIGS. 2–4 illustrate the manner of assembling the present invention. As shown best in FIG. 3, an overlap portion 36 of the lower piece 26 initially overlaps the periphery 38 of the upper piece 24. This is acceptable at this stage of the manufacturing process, since the lower piece 26 is not designed to fit precisely in a tight multi-planar fit.

Also, as shown best in FIG. 2, plural, preferably, four, upper holes 40 are drilled vertically into the upper piece 24 and four lower holes 42 are drilled into the lower piece 26. The lower holes 42 pass completely through the lower piece 26, whereas the upper holes 40 pass only part way through the upper piece 24. Plural bolts 44 register pairs of holes 40, 42 and hold the pieces 24, 26 together. Also, adhesive can be used to hold the pieces together.

Next, the overlap portion 36 is removed by, e.g., grinding and polishing, such that the periphery 46 of the lower piece 26 is contiguous to the periphery 38 of the upper piece 24 as shown in FIG. 4. In other words, after grinding and/or polishing, the upper and lower pieces 24, 26 fit smoothly together as shown in FIG. 4. Any portion of the bolts 44 (FIG. 2) that protrude beyond the bottom surface 48 of the lower piece 26 are then cut away and polished such that nothing protrudes below the bottom surface 48.

Figure 5:
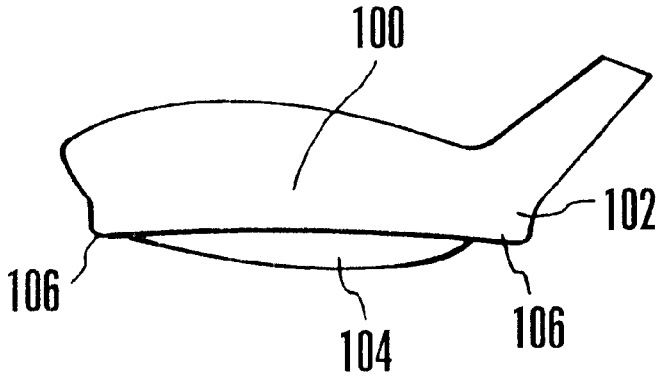
FIG. 5 is a side view of an alternate club head prior to removing overlap areas of an upper piece.

It is to be understood that the above principles apply equally when an upper piece 100 of a golf club head 102 overlaps a lower piece 104 of the head 102, as seen in FIG. 5. In such an embodiment, overlap portions 106 of the upper piece 102 are removed by grinding or polishing.

In any case, it is to be appreciated that with the present invention, it is not necessary to make the upper and lower pieces while maintaining exact dimensional control, in contrast the above-referenced patent to Ashcraft et al., which requires machining to obtain the necessary fit. As recognized herein, such machining can be relatively expensive, particularly when titanium, tungsten, nickel, iron, or copper is the metal used for one of the upper or lower pieces.

While the particular BI-METALLIC GOLF CLUB HEAD WITH SINGLE PLANE INTERFACE as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more". All structural and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims.

What is claimed is:

1. A golf club head, comprising:

an upper metal piece defining an upper engagement surface, the upper engagement surface lying substantially entirely in a single plane;

a hollow lower metal piece defining a lower engagement surface positioned flush against the upper engagement surface to define a substantially single-plane interface between the lower and upper pieces, the lower and upper pieces not interfacing with each other apart from the single-plane interface; and at least one fastener engaged with the pieces, the upper metal piece being devoid of any weighting elements denser than the upper piece above the plane apart from the fastener.

2. The club head of claim 1, wherein the upper piece has a first density and the lower piece has a second density, and the first density is less than the second.

3. The club head of claim 1, wherein the upper piece has a first weight and the lower piece has a second weight, and the first weight is less than the second.

4. The club head of claim 1, wherein the upper piece includes a material selected from the group of materials including titanium and aluminum, and the lower piece includes at least one of: copper, iron, nickel, or tungsten.

5. The club head of claim 4, wherein the upper piece includes titanium and the lower piece includes at least tungsten.

6. The club head of claim 1, in combination with a golf club shaft to establish a golf club.

7. The club head of claim 1, further comprising plural bolts engaging the pieces.

8. A golf club head, comprising:

an upper head piece;

a hollow lower head piece;

one and only one substantially planar interface therebetween; and at least one fastener engaged with the pieces, the upper piece being devoid of any weighting elements denser than the upper piece above the planar interface apart from the fastener.

9. The golf club head of claim 8, wherein the upper piece has a first density and the lower piece has a second density, and the first density is less than the second.

10. The club head of claim 8, wherein the upper piece includes a material selected from the group of materials including titanium and aluminum, and the lower piece includes at least one of: copper, iron, nickel, or tungsten.

11. The club head of claim 10, wherein the upper piece includes titanium and the lower piece includes tungsten.

12. The club head of claim 8, in combination with a golf club shaft to establish a golf club.

13. The club head of claim 8, further comprising plural bolts engaging the pieces.

* * * * *